US011589660B2

(12) United States Patent
Thompson et al.

(10) Patent No.: US 11,589,660 B2
(45) Date of Patent: Feb. 28, 2023

(54) HAND HELD APPLIANCE

(71) Applicant: Dyson Technology Limited, Wiltshire (GB)

(72) Inventors: Daniel John Thompson, Bristol (GB); Lauren Elise Fairholm, Toronto (CA)

(73) Assignee: Dyson Technology Limited, Malmesbury (GB)

( * ) Notice: Subject to any disclaimer, the term of this patent is extended or adjusted under 35 U.S.C. 154(b) by 1288 days.

(21) Appl. No.: 15/689,705

(22) Filed: Aug. 29, 2017

(65) Prior Publication Data

US 2018/0055182 A1 Mar. 1, 2018

(30) Foreign Application Priority Data

Sep. 1, 2016 (GB) ..... 1614825

(51) Int. Cl.
*A45D 2/36* (2006.01)
*A45D 1/00* (2006.01)
(Continued)

(52) U.S. Cl.
CPC ..... *A45D 2/36* (2013.01); *A45D 1/00* (2013.01); *A45D 2/2457* (2013.01); *A45D 2/30* (2013.01);
(Continued)

(58) Field of Classification Search
CPC . A45D 1/28; A45D 2/367; A45D 6/02; A45D 6/04; A45D 20/48; A45D 20/50;
(Continued)

(56) References Cited

U.S. PATENT DOCUMENTS 3,280,439 A 10/1966 McCarthy
3,771,186 A * 11/1973 Moret ..... A61C 17/028 15/22.1
(Continued)

FOREIGN PATENT DOCUMENTS

CN 205250656 U 5/2016
CN 207927983 U 10/2018
(Continued)

OTHER PUBLICATIONS

Search Report dated Feb. 10, 2017, directed to GB Application No. 1614825.6; 1 page.
(Continued)

*Primary Examiner* — Nicholas D Lucchesi
(74) *Attorney, Agent, or Firm* — Faegre Drinker Biddle & Reath LLP

(57) ABSTRACT

A handheld appliance having a body and an attachment, the body includes an attachment mechanism having a slot and an actuator, the attachment including a protrusion adapted to engage with the slot wherein the actuator has a first position and a second position and the actuator is moved from the first position towards the second position as the protrusion engages with the slot. In the first position the actuator may at least partially obscures the slot. The actuator includes a surface which may interact with the protrusion when the protrusion engages with the slot. The surface may be adapted to at least partially define the slot at or near the second position. When the protrusion is at a pre-determined position within the slot, the actuator may return towards the first position. The actuator may be biased into the first position.

39 Claims, 6 Drawing Sheets

(51) Int. Cl.

| | |
|---|---|
| ***A46B 15/00*** | (2006.01) |
| ***A46B 5/00*** | (2006.01) |
| ***A45D 2/24*** | (2006.01) |
| ***A45D 2/30*** | (2006.01) |
| ***A45D 20/12*** | (2006.01) |

(52) U.S. Cl.
CPC ..... *A45D 20/12* (2013.01); *A46B 5/0095* (2013.01); *A46B 15/003* (2013.01); *A45D 2001/002* (2013.01); *A46B 2200/104* (2013.01)

(58) Field of Classification Search
CPC ..... A45D 2/36; A45D 1/00; A45D 2/2457; A45D 2/30; A45D 20/12; A46B 5/0095; A46B 15/003
See application file for complete search history.

(56) References Cited

U.S. PATENT DOCUMENTS

| | | | | |
|---|---|---|---|---|
| 3,955,064 | A | 5/1976 | Demetrio et al. | |
| 4,034,201 | A | 7/1977 | Walter et al. | |
| 4,365,426 | A | 12/1982 | Suzuki et al. | |
| 4,851,641 | A | 7/1989 | Barowski et al. | |
| 5,346,394 | A * | 9/1994 | DeStefanis | A61C 13/0028 433/32 |
| 5,464,301 | A * | 11/1995 | Kramer | F16D 1/108 403/325 |
| 5,887,600 | A * | 3/1999 | Wilk | A45D 6/04 132/150 |
| 5,992,423 | A * | 11/1999 | Tevolini | A45D 2/2471 132/120 |
| 6,029,307 | A | 2/2000 | Baudoin | |
| 6,067,724 | A | 5/2000 | Depoyian | |
| 6,502,585 | B1 | 1/2003 | Mazzei et al. | |
| 6,725,562 | B2 * | 4/2004 | Nakagawa | A45D 20/12 34/96 |
| 7,296,580 | B1 * | 11/2007 | Sbardella | A45D 2/122 132/122 |
| 10,143,284 | B2 * | 12/2018 | Depoyian | A45D 1/04 |
| 2005/0284856 | A1 | 12/2005 | Cafaro et al. | |
| 2008/0105274 | A1 | 5/2008 | Kennedy | |
| 2008/0202545 | A1 | 8/2008 | Purvis et al. | |
| 2012/0152272 | A1 | 6/2012 | Solovey | |
| 2013/0025106 | A1 | 1/2013 | Hernandez-Laines | |
| 2015/0209125 | A1 * | 7/2015 | Fattori | A61C 17/225 15/22.1 |
| 2015/0265022 | A1 | 9/2015 | Maclaine | |
| 2016/0199612 | A1 * | 7/2016 | Foote | A61M 16/0875 128/202.27 |

FOREIGN PATENT DOCUMENTS

| | | |
|---|---|---|
| DE | 102 39 716 | 3/2004 |
| EP | 0 250 992 | 1/1988 |
| EP | 0 300 281 | 1/1989 |
| FR | 2789880 | 8/2000 |
| GB | 1131427 | 10/1968 |
| GB | 1 456 000 | 11/1976 |
| GB | 1 494 611 | 12/1977 |
| GB | 1 530 360 | 10/1978 |
| GB | 2 021 943 | 12/1979 |
| JP | 45-13287 | 5/1970 |
| JP | 59-186505 | 10/1984 |
| JP | 64-72706 | 3/1989 |
| JP | 6-237815 | 8/1994 |
| JP | 11-235224 | 8/1999 |
| JP | 2001-353020 | 12/2001 |
| JP | 2007-105144 | 4/2007 |
| JP | 2008-105454 | 5/2008 |
| JP | 2015-181947 | 10/2015 |
| TW | M259504 | 3/2005 |
| WO | WO-95/20339 | 8/1995 |
| WO | 2015/140506 | 9/2015 |

OTHER PUBLICATIONS

Search Report dated Dec. 11, 2018, directed to GB Application No. 1819049.6; 1 page.
Search Report dated Jun. 28, 2018, directed to GB Application No. 1614825.6; 1 page.
International Search Report dated Jan. 24, 2018, directed to International Application No. PCT/GB2017/052427; 5 pages.
The First Office Action dated May 28, 2020, directed to CN Application No. 201710780561.1; 20 pages.
Notification of Grounds for Rejection dated Dec. 10, 2018, directed to JP Application No. 2017-168409; 10 pages.

* cited by examiner

HAND HELD APPLIANCE

REFERENCE TO RELATED APPLICATIONS

This application claims the priority of United Kingdom Application No. 1614825.6, filed Sep. 1, 2016, the entire contents of which are incorporated herein by reference.

FIELD OF THE INVENTION

This invention relates to a handheld appliance and in particular to a hair care appliance such as a hot styling device.

BACKGROUND OF THE INVENTION

In a conventional hot styling appliance, air is drawn into an inlet by a fan unit and directed towards the hair by an outlet. Often, one appliance is provided with different attachments, each having a different outlet and thus a different function, for example drying, curling or volumising. Depending on the style desired, the air may or may not be heated. The attachment may include bristles onto which hair is wrapped and held for styling.

The appliance and attachments are provided with a connection mechanism which may or may not include an interlock to prevent the appliance being activated without an attachment provided. One problem is to provide a solid connection between the attachment and the appliance for when hair is under tension with an easily removable attachment when required.

SUMMARY OF THE INVENTION

According to some embodiments, the invention provides a handheld appliance having a body and an attachment, the body comprising an attachment mechanism having a slot and an actuator.

Preferably, the attachment comprises a protrusion adapted to engage with the slot.

In a preferred embodiment, the actuator has a first position and a second position and the actuator is moved from the first position towards the second position as the protrusion engages with the slot.

Preferably, in the first position the actuator at least partially obscures the slot.

In a preferred embodiment, the actuator comprises a surface which interacts with the protrusion when the protrusion engages with the slot.

Preferably, the surface is adapted to at least partially define the slot at or near the second position.

In a preferred embodiment, when the protrusion is at a pre-determined position within the slot, the actuator returns towards the first position.

Preferably, the actuator is biased into the first position.

In a preferred embodiment, the actuator retains the attachment on the body.

Preferably, the body extends along a longitudinal axis and the slot extends both radially around and axially along the body.

In a preferred embodiment, the protrusion comprises a first face for engagement with the actuator.

Preferably, the first face engages with the surface of the actuator.

In a preferred embodiment, the body comprises a wall having an outer surface and an inner surface wherein the slot is a closed channel formed in the inner surface having a closed end defined by a recess formed at the end of the channel.

Preferably, the recess is defined by a wall of the slot.

In a preferred embodiment, the protrusion comprises a second face for engagement with the wall of the slot.

Preferably, the second face is curved.

In a preferred embodiment, the actuator comprises a second surface which interacts with the protrusion when the protrusion engages with the recess.

Preferably, the body has a first end and a second end and the attachment mechanism is adjacent the second end.

In a preferred embodiment, the body comprises a wall having an outer surface and an inner surface wherein at the second end, the wall comprises a chamfer extending around the inner surface.

Preferably, the chamfer extends from the inner surface towards the outer surface. The chamfer extends from the inner surface of the wall towards the second end. Thus, at or near the second end, the wall is angled with respect to the longitudinal axis X-X of the body.

In a preferred embodiment, the attachment comprises a collar extending around the attachment wherein the protrusion extends from the collar. Preferably, the attachment comprises a fluid outlet, a collar and between the fluid outlet and the collar a flange is provided and the flange extends radially outwards from both the fluid outlet and the collar.

Preferably, the attachment comprises a first end and a second end wherein the collar is adjacent the first end and the collar comprises a further chamfer Preferably, the chamfer extends between the collar and the flange.

In a preferred embodiment, the chamfer is at the distal end of the collar from the first end of the attachment.

Preferably, the further chamfer extends from the collar radially outwards and towards the second end of the attachment.

In a preferred embodiment, the chamfer on the body and the further chamfer on the attachment engage each other as the attachment is attached to the body.

A further aspect of the invention provides a handheld appliance having a body and an attachment, the body comprising an attachment mechanism wherein the body has a first end and a second end and the attachment mechanism is adjacent the second end wherein the body comprises a wall having an outer surface and an inner surface wherein at the second end, the wall comprises a chamfer extending around the inner surface.

Preferably, the chamfer extends from the inner surface towards the outer surface of the wall.

Preferably, the attachment comprises a first end and a second end and a collar extends around the attachment adjacent the first end and the collar comprises a further chamfer Preferably, between the fluid outlet of the attachment and the collar a flange is provided. Preferably, the chamfer extends between the collar and the flange.

In a preferred embodiment, the further chamfer is at the distal end of the collar from the first end of the attachment.

Preferably, the further chamfer extends from the collar radially outwards and towards the second end of the attachment.

In a preferred embodiment, the chamfer on the body and the further chamfer on the attachment engage each other as the attachment is attached to the body.

Preferably, the appliance further comprises a user operated button which engages with the actuator.

In a preferred embodiment, actuation of the button moves the actuator from the first position to the second position to facilitate removal of an attachment from the body.

Preferably, the appliance comprises a second protrusion and a second slot.

In a preferred embodiment, the second protrusion and second slot are radially spaced from the protrusion and slot.

Preferably, the second protrusion is adapted to cooperate with the second slot but not the slot.

In a preferred embodiment, a third protrusion and a fourth protrusion and a third slot and a fourth slot are provided.

Preferably, the fourth protrusion is adapted to cooperate with the second slot or the fourth slot but not the slot or the third slot.

In a preferred embodiment, each of the protrusion, second protrusion, third protrusion and fourth protrusion are radially spaced around the attachment.

Preferably, each of the slot, second slot, third slot and the fourth slot are radially spaced around the body.

Preferably there are four protrusions and four slots. In a preferred embodiment, the four protrusions and four slots are equally radially spaced around the collar of the attachment and attachment collar of the body respectively. Preferably, one pair of protrusions and one pair of slots are smaller in at least one dimension than another pair of protrusions and one pair of slots. Preferably, a pair of protrusions or a pair of slots is formed diametrically opposite one another. In a preferred embodiment, the one pair of protrusions extend radially out from the collar a smaller distance than another pair of protrusions and the one pair of slots extend radially within the inner surface of the wall of the body a smaller distance than another pair of slots.

This means that the attachment can only be positioned on the body in two orientations where the smaller pair of slots and protrusions are aligned.

Preferably, the appliance is a hair care appliance.

In a preferred embodiment, the hair care appliance is a hot styling appliance.

BRIEF DESCRIPTION OF THE DRAWINGS

The invention will now be described by way of example, with reference to the accompanying drawings, of which.

DETAILED DESCRIPTION OF THE INVENTION

Figure 9:
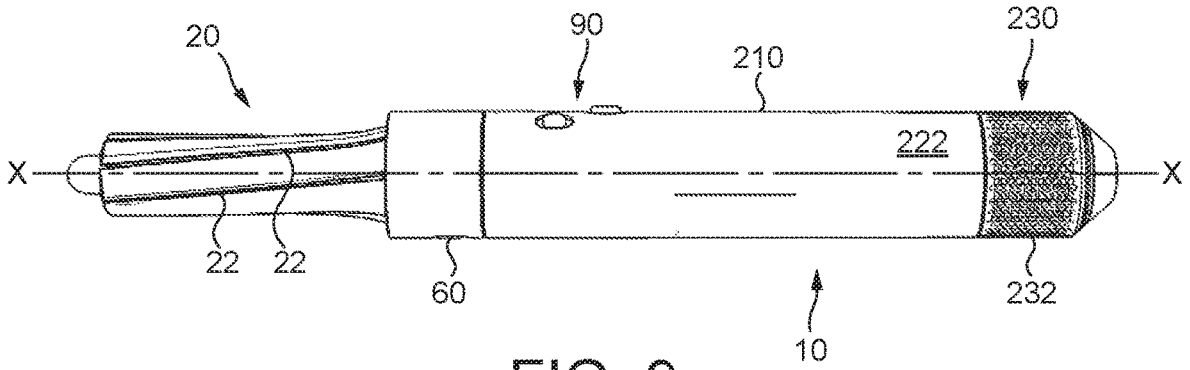
FIG. 9 shows an appliance on which an attachment mechanism according to the invention can be utilised.

FIG. 9 shows an example of a hot air styling device 10 together with attachment 20. In order to enable a user to create different styles and to give the appliance multi functionality, the attachment 20 is removable and can be replaced with an alternative attachment. In addition, the attachment 20 can be removed to allow easier storage of the appliance when not in use. The hot air styling device 10 comprises a body 210 having an outer wall which functions as a handle an fluid inlet 230 at first end 210*a*, fluid then flow through the body 210 and into the attachment 20 to a fluid outlet 26 from the attachment 20. At the fluid inlet 230 of the handle, an array of apertures 232 extends around and partially along the handle 220. Internally (not shown), is a fan unit which comprises a fan and a motor. In use, the motor drives the fan and air is drawn in through the apertures 232 of the fluid inlet 230, along an fluid flow path which extends within the body 210. The fluid is optionally heated by a heater (not shown) before exiting the hot air styling device at the fluid outlet 26. The appliance 10 may be connected to a power supply via a power cable or could house batteries within the body 210. In this embodiment, the fluid outlet 26 comprises a plurality of slots extending along the attachment 20 and radially around the attachment. The body 210 includes a user interface 90 which typically includes an on-off button and temperature and/or flow control settings and a button 60 for releasing an attachment 20 from the body 210. In this embodiment, the user interface 90 and the button 60 are located approximately diametrically opposite one another on the body 210.

Referring to FIGS. 1*a* to 5, a portion of a handheld appliance 10 is shown. The appliance 10 includes a body 210 having a wall 220. The body 210 also functions as a handle. The body 210 has an attachment collar 230 and the attachment collar 230 includes at least a portion of the attachment mechanism, namely at least one slot 232 in the attachment collar 230 for engagement with at least one protrusion 30 provided on the attachment 20. In this example there are four slots and four protrusions. The attachment comprises the fluid outlet 26 and a collar 22 from which the at least one protrusion 30 extends. Between the fluid outlet 26 and the collar 22 is a flange 234 and the flange 234 extends radially outwards from both the fluid outlet 26 and the collar 22. The attachment 20 comprises a wall 24 having a radially inner surface 24*a* and a radially outer surface 24*b* and the at least one protrusion extends radially outwards from the outer surface 24*b*.

In order to secure the attachment 20 to the body 210, the attachment 20 is presented to the attachment collar 230 and turned until the at least one protrusion 30 aligns with the at least one slot 232.

Figure 6A:
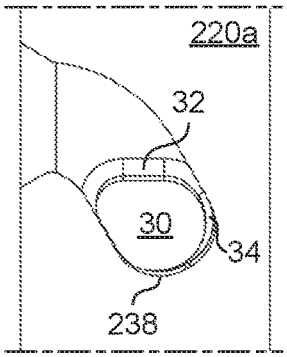
FIG. 6*a* shows an enlarged view of a protrusion within a slot.
Figure 6B:
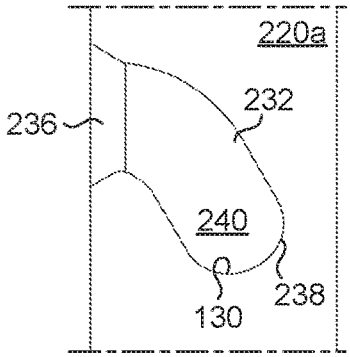
FIG. 6*b* shows an enlarged view of a slot.

Referring to FIGS. 6*a* and 6*b* in particular, each of the slots 232 has an opening 236 in an end face 242 of the attachment collar 230. The opening 236 is conveniently conical presenting a larger aperture than required at the end face 242 to facilitate entry of a protrusion into a slot. The slot 232 constantly curves around the attachment collar 230, and thus, as the protrusion 30 is pushed into the slot 232 it automatically twists in the direction of the slot 232. The slot 232 extends radially around the body 210 and axially along the body 210.

A slot 232*a* includes an actuator 50 which is adapted to retain the attachment 20 on the body 210 until the user wishes to change the attachment or remove the attachment for storage purposes. The actuator 50 has a first part 52 which physically retains a protrusion 30 within slot 232*a* and a second part 54 which a user interacts with. The body 210 has a longitudinal axis X-X and the actuator 50 extends along this axis X-X. The first part 52 of the actuator 50 engages with the slot 232*a* and is movable with respect to the slot 232*a*. The first part 52 of the actuator 50 functions to retain the protrusion 30 in the slot 232*a* until the user moves the actuator 50 to allow the protrusion 30 to be removed from the slot 232*a*.

The body 210 includes a first aperture 110 which extends into the attachment collar 230 and a second aperture 212 which extends along the wall 220. The first aperture 110 is for housing the first part 52 of the actuator 50 and the second aperture 212 is for housing the second part 54 of the actuator 50 and a spring 214. The spring 214 extends between the distal end 54*a* of the second part 54 from attachment collar 230 and the distal end 212*a* of the second aperture 212 from the attachment collar 230. Retaining pips 216 are provided on the actuator 50 and second aperture 212 over which a respective end of the spring 214 is placed (spring not shown in FIG. 3). The spring 214 biases the actuator 50 towards the attachment collar 232.

The second part 54 of the actuator 50 is, in this embodiment, rectangular and is provided with feet 56 which are adapted to engage with ledges 218 provided along two edges of the first aperture 212. This provides stability for the actuator 50 as it slides within the first aperture 212. The bias is overcome by a user sliding the actuator 50 against the force of the spring 214.

In order for a user to interact with the actuator 50, a button 60 is provided. The button 60 has a protrusion 62 which engages with a recess 58 within the second part 54 of the actuator 50. The body 210 has wall 220 in which the first aperture 212 for housing the actuator 50 is located. The body 210 also has an outer tube 222 which extends radially around the external periphery of the wall 220 and it is the outer tube 222 that a user holds. The outer tube 222 includes another aperture 224 through which the button 60 extends so it can be activated by a user. The button 60 is typically glued to the actuator 50.

Figure 2:
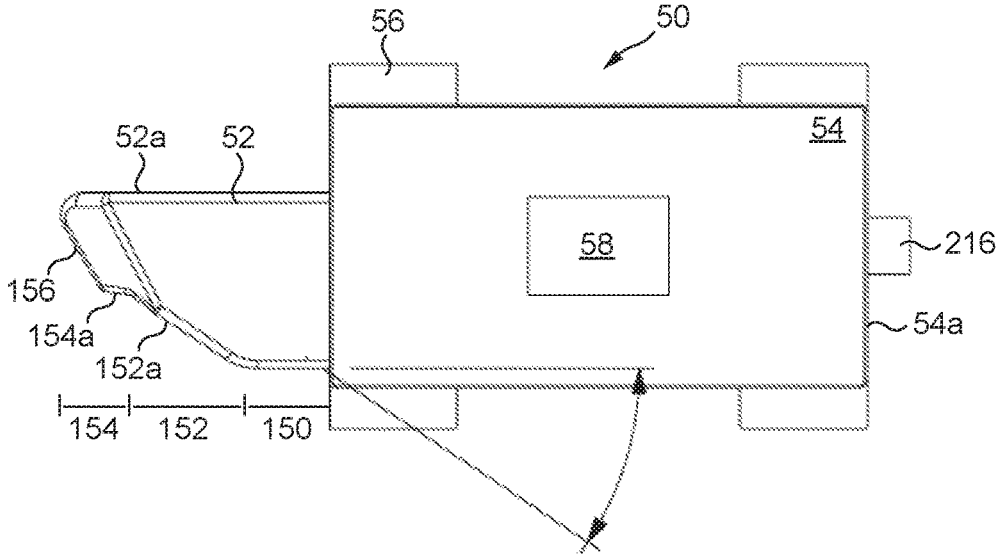
FIG. 2 shows a side view of an actuator for an attachment mechanism according to the invention.

Referring in particular to FIG. 2, the actuator 50 will be described in more detail. As previously described, the second part 54 of the actuator is generally rectangular. The first part 52 has a number of different regions. The first part 52 is smaller in cross section than the second part 54 firstly, as it moves within a slot 232 the first part 52 determines the size of the slot 232 and hence the size of the protrusion 30 which engages the slot 232. Secondly, the second part 54 provides a platform for a button 60 and for the user to engage with so a wider part is more stable.

The first part 52 has a first side 52*a* which extends along the length of the first part 52 and is aligned with the longitudinal axis X-X of the body 210. The first part 52 has a first region 150 which extends from the second part 54 and is generally rectangular and narrower that the second part 54.

A second region 152 extends from the first region 150 and has one side 152*a* which is angled with respect to the longitudinal axis X-X causing the first part 52 to narrow in this second region 152 producing a wedge shape. The one side 152*a* is angled between 8 and 59° to the longitudinal axis X-X. Preferably, between 20 and 57° to the longitudinal axis X-X. More preferably between 30 and 40° to the longitudinal axis X-X. Most preferably, 33.3° to the longitudinal axis X-X.

A third region 154 extends from the second region 152 and has one side 154*a* which extends along the longitudinal axis X-X of the body 210. At the distal end of the first part 52 from the second part 54 a surface 156 is provided. The surface 156 is an end face of the actuator and is angled with respect to the first side 52*a*, which will be explained with reference to FIGS. 1*a* and 1*b* in particular.

Figure 5:
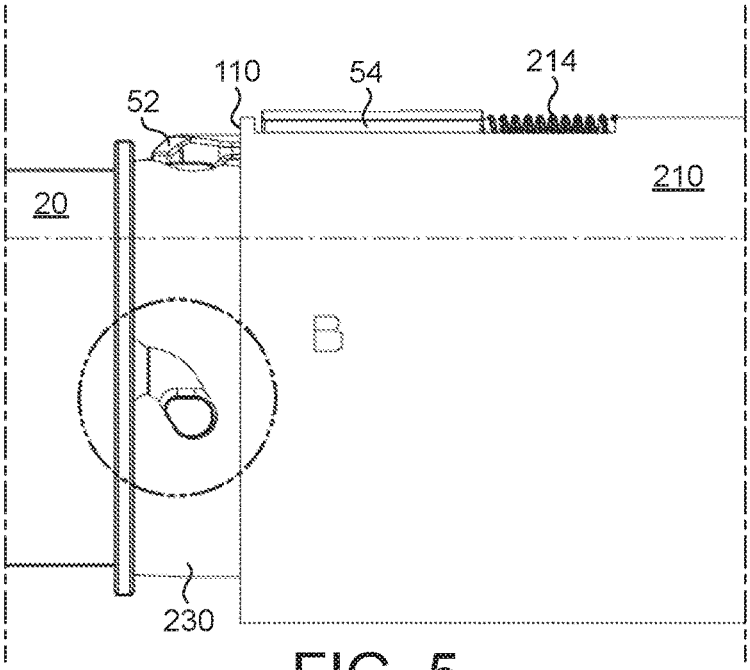
FIG. 5 shows an alternative cross section through an attachment mechanism according to the invention.

The actuator 50 is also a non-uniform shape through the thickness of the actuator 50. Referring in particular to FIG. 5, the second part 54 of the actuator 50 has a nominal thickness t1 apart from recess 58 for accommodating the protrusion 62 of button 60. The first part 52 is initially thinner t2 than the second part 54 then towards the surface 156 of the actuator it thickens t3. The thin central section 80 moves through the first aperture 110 provided in the attachment collar 230. It is thin so the first aperture 110 can be small so the structural integrity of the attachment collar 230 is not compromised. The two thicker sections also provide stop features that inhibit movement of the actuator 50. The end wall 64 of the second part 54 of the actuator 50 formed at the junction between the first part 52 and the second part 54 of the actuator 50 by the reduction in thickness of the actuator 50 between the first part 52 and the second part 54 retains the second part 54 of the actuator 50 within the second aperture 212. Towards the surface 156 of the first part 52 of the actuator 50, the actuator thickens 66. In this example the increase in thickness is on an inner surface 52*a* of the first part 52 of the actuator 50. This prevents a user from sliding the first part 52 of the actuator 50 out of the first aperture 110.

The first aperture 110 in the attachment collar 230 is a guiding channel which, along with the stop features—end wall 64 and localised thickening 66—maintains the actuator within a housing formed by the attachment collar 230, second aperture 212 and outer tube 222.

Figure 1A:
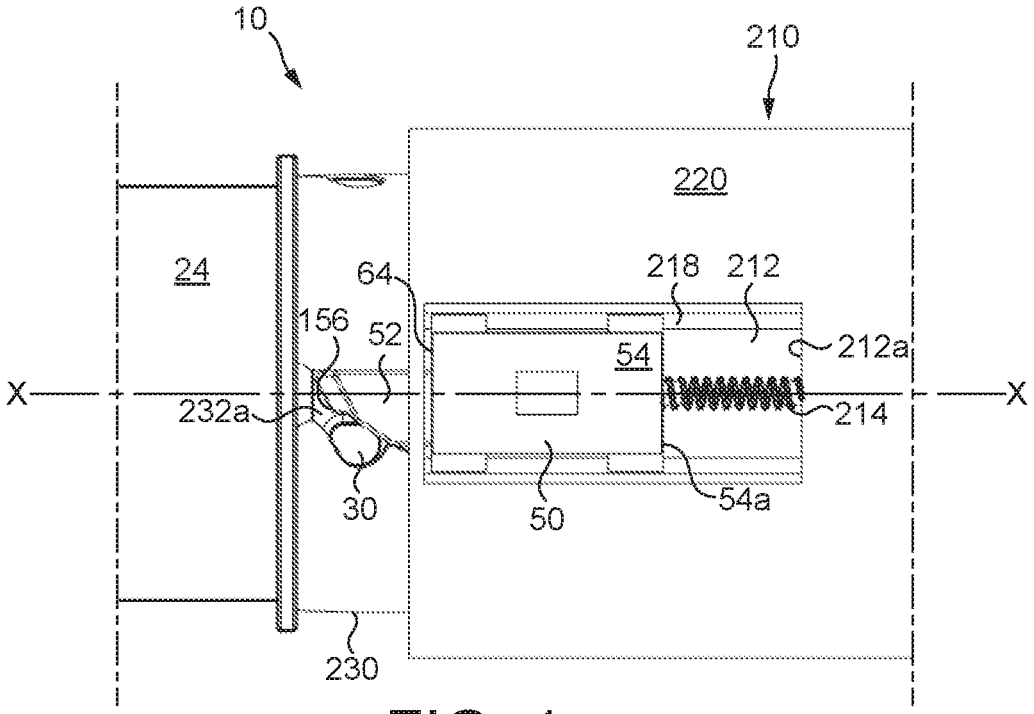
FIGS. 1*a* and 1*b* show cross sections through an attachment mechanism according to the invention.
Figure 1B:
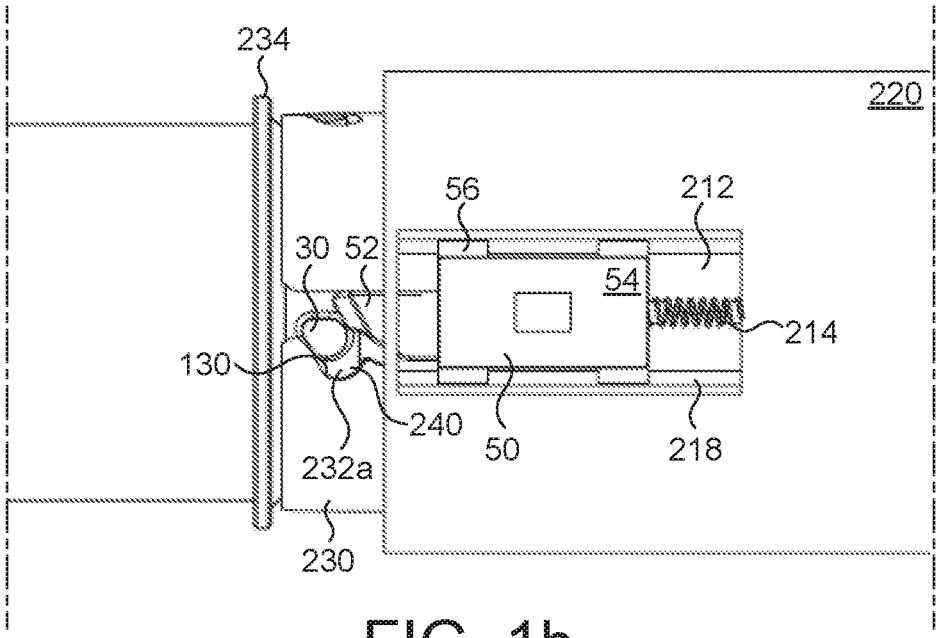

FIG. 1*a* shows the attachment 20 when attached to the body 210. FIG. 1*b* shows the attachment 20 either being attached or detached from the body 210. Due to the action of the spring 214 the actuator is biased into a first position, shown in FIG. 1*a*, where the end wall 64 of the second part 54 of the actuator 50 is adjacent the attachment collar 230 and the first part 52 of the actuator 50 obscures the slot 232*a*.

The surface 156 of the actuator 50 is angled with respect to the longitudinal axis X-X of the body 210 and mimics the curve of the slot 232*a*. Thus, as the protrusion 30 is pushed into the slot 232*a*, the actuator 50 is pushed along the longitudinal axis X-X of the body 210 towards a second position (FIG. 1*b*). This opens the slot 232*a* and enables the protrusion 30 to enter the slot 232*a*. Once the protrusion 30 has passed the surface 156 of the actuator 50 the actuator returns towards the first position.

Each slot 232, 232*a* is a closed channel within an inner surface 220*a* of the wall 220 and is located within the attachment collar 230. The slot 232*a* has an opening 236 for receiving a protrusion 30 and it curves along and partially around the circumference of the attachment collar 230 to an end 238 of the channel. The end 238 of the channel provides a recess 240 adapted to receive a protrusion 30. The recess 240 is defined by a wall 130 of the slot 232*a*.

In the first position, the actuator 50 prevents the protrusion 30 from being removed from the slot 232*a* as the second region 152 of the actuator 50 and in particular the one side 152*a* which is angled pushes the protrusion 30 towards the end 238 and into the recess 240.

In order to remove an attachment 20, a user slides the button 60 away from the attachment collar 230. This causes the actuator 50 to move within the second aperture 212 against the biasing force of the spring 214 and moves the first part 52 of the actuator 50 with respect to the slot 232*a* until the slot 232*a* is no longer obscured by the actuator 50 and the protrusion 30 can move along the slot 232*a* towards the slot opening 236.

The protrusion has a first face 32 which engages with the actuator 50 when it is presented to the slot 232*a*. The protrusion has a second curved face 34 which is shaped and sized to fit within the recess 240. In this example, the protrusion 30 has the shape of a teardrop. The attachment 20 has a longitudinal axis Y-Y which is parallel to the longitudinal axis X-X of the body 210 when attached thereto. The first face 32 of the protrusion 30 is parallel with the longitudinal axis Y-Y of the attachment 20.

Having a curved slot 232, 232*a* is advantageous over a traditional bayonet fitting. A bayonet fitting has two sections which are angled with respect to one another and the user pushes along a first axis and then twists about a second axis to cause attachment. This results in an attachment mechanism that is relatively large which relies on the path length and change in direction within the fitting to maintain attachment. In contrast, the curved slot of the present invention in conjunction with the actuator enables the user to push along a first axis only until the first face 32 of the protrusion 30 bypasses the one side 152*a* of the actuator 50 which is angled with respect to the longitudinal axis X-X. After this point, the biasing action of the spring 214 causes the first part 52 of the actuator 50 to move towards the slot opening 236 and pushes the protrusion 30 into the recess 240 formed in the slot 232*a*. Thus, the user only has to push the attachment 20 onto the body 210 a relatively short amount and then the actuator 50 completes the movement. Due to the action of the spring 214, the first part 52 of the actuator 50 pushes the protrusion 30 towards the recess 240.

In addition having the curved slot and actuator allows for a relatively short path length compared to traditional bayonet fittings so the attachment collar 232 may be significantly smaller; perhaps by a factor or two of three times shorter.

The use of an actuator 50 having the one side 152*a* which is angled also assists in the stability of the attachment 20 on the body 210. The actuator 50 and in particular the one side 152*a* pushes the protrusion 30 into the recess 240 at the end of the slot 232*a* and any differences in the size of the protrusion 50, slot 232*a* and actuator 50 are accounted for as the first part 52 of the actuator 50 will rest in slightly different positions with respect to the slot 232*a* dependent on these differences.

Figure 4A:
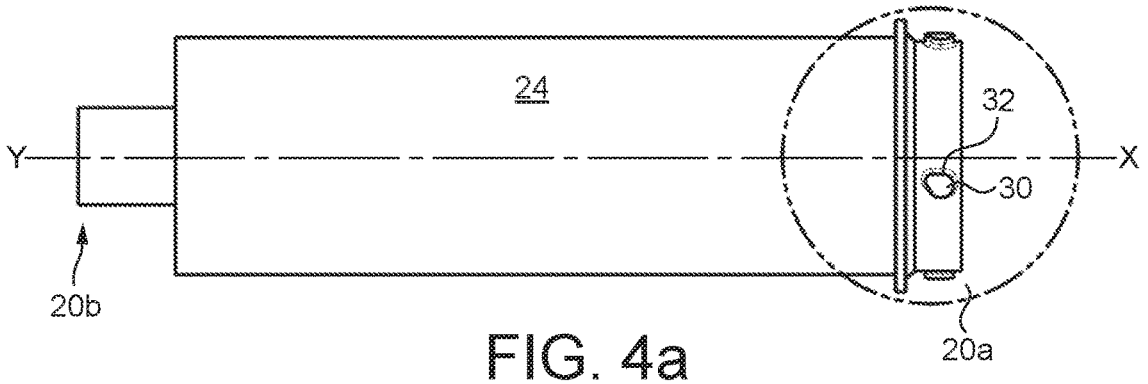
FIG. 4*a* shows a side view of an attachment.
Figure 4B:
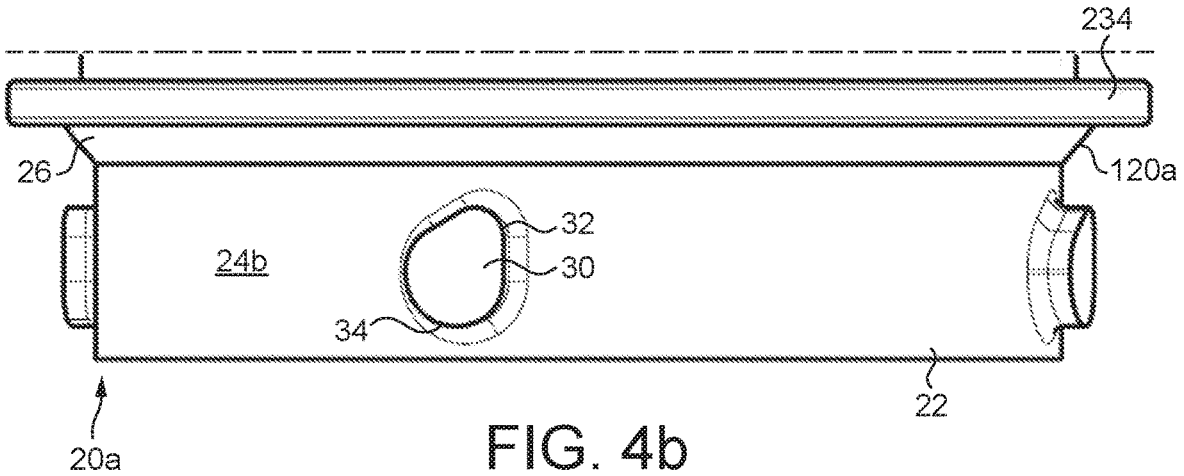
FIG. 4*b* shows an enlarged view of a protrusion used on the attachment of FIG. 4*a;*
Figure 3:
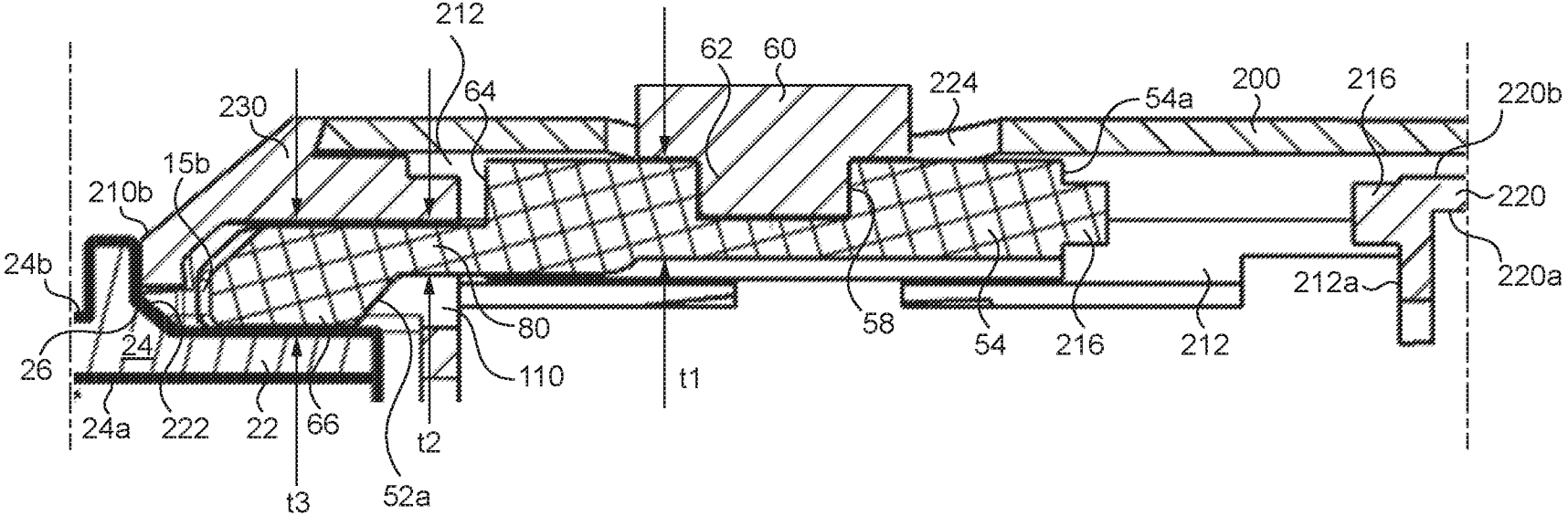
FIG. 3 shows a side view of an attachment mechanism according to the invention.
Figure 7:
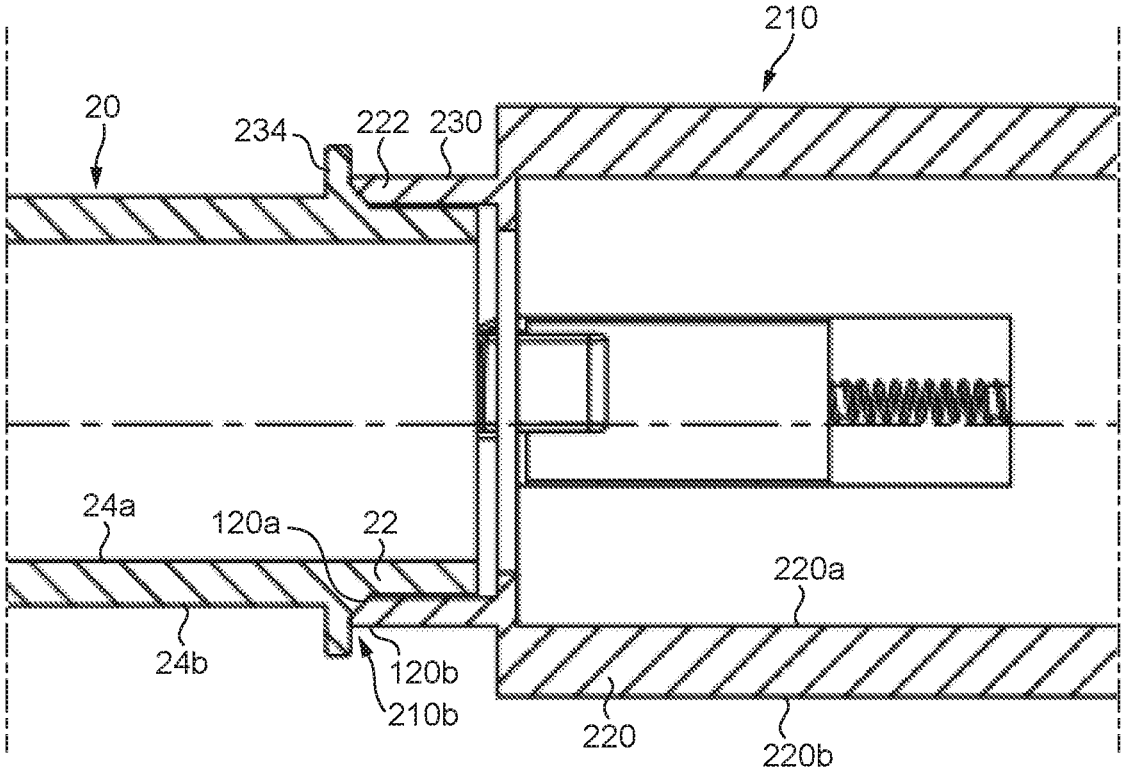
FIG. 7 shows a cross section through aside view of an attachment when attached to the appliance.
Figure 8:
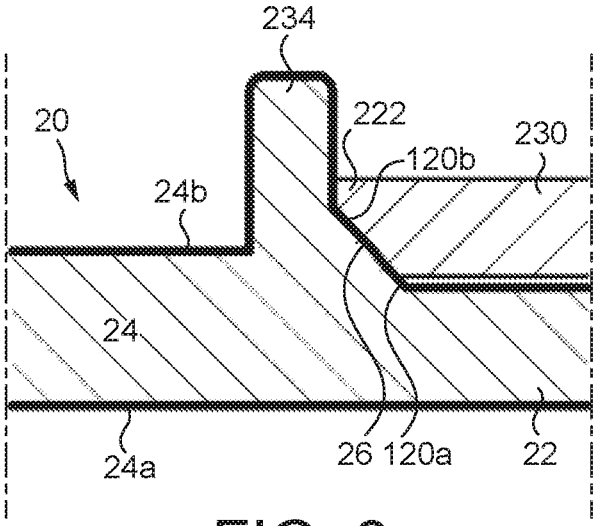
FIG. 8 shows an enlarged portion of the attachment of FIG. 7.

Another feature that can improve the stability of the attachment, will be discussed with reference to FIGS. 4*b*, 7 and 8 in particular. The attachment 20 and the attachment collar 230 on the body 210 have respective mating faces 120*a*, 120*b*. The mating face 120*a* of the attachment 20 is angled with respect to the longitudinal axis Y-Y of the attachment. The mating face 120*b* of the attachment collar 230 is angled with respect to the longitudinal axis X-X of the appliance. Both of the mating faces 120*a*, 120*b* are formed as chamfers 26, 222 which extend radially around the attachment 20 or attachment collar 230 respectively. In this embodiment the mating faces 120*a*, 120*b* have the same but opposite angle of inclination from the respective longitudinal axis of the attachment Y-Y or the appliance X-X. This is not essential, the angles must be opposite so they are coincident but they need not be the exact same angle. The angle can be between 15 and 75°, and is preferably 35 to 50° and more preferably around 40°. When an attachment 20 is presented to the body 210, the protrusions 30 first align with slots 232, 232*a*. The protrusions 30, once they are pushed passed the third region 154 of the first part 52 of the actuator 50 are automatically pushed towards the recess 240 formed at the end 238 of the channel by the second region 152 of the first part 52 of the actuator 50.

The body 210 has a first end 210*a* and a second end 210*b* and the attachment collar 230 which houses at least a portion of the attachment mechanism is adjacent the second end 210*b*. The body has a wall 220 having an outer surface 220*b* and an inner surface 220*a* and at the second end 210*b*, the wall 220 comprises a chamfer 222 extending around the inner surface 220*a*. The chamfer 222 extends from the inner surface 220*a* towards the outer surface 220*b* towards the second end 210*b*.

The attachment 20 has first end 20*a* which attaches to the body 210 and a second end 20*b* distal to the body 210. At the first end 20*a*, a collar 22 extends around the attachment 20. The protrusion 30 extends from the collar 22 and extends radially outwards from the outer surface 24*b* of the wall 24 of the attachment. Between the collar 22 and the fluid outlet 26 a flange 234 is provided. The flange 234 extends radially outwards from the outer surface 24*b* of the attachment 20. The collar 22 includes a further chamfer 26 which extends between the flange 234 and the collar 22. The further chamfer 26 extends from the collar 22 radially outwards and towards the second end 20*b* of the attachment 20. Thus the further chamfer 26 is oppositely inclined to the chamfer 222 so as to produce mating faces 120*a*, 120*b*. Therefore when the attachment 20 is attached to the body 210 the chamfer 222 on the body 210 and the further chamfer 26 on the attachment 20 engage each other.

Whilst this further automatic twist of the attachment 20 with respect to the body 210 occurs, the mating faces 120*a* and 120*b* of the attachment 20 and attachment collar 230 engage radially around the attachment 20 and attachment collar 230 to further secure the attachment 20 to the body 210. The use of the actuator with different surfaces 156, 154*a*, 152*a* that engage with different faces 32, 34 of a protrusion 30 along with the mating faces 120*a* and 120*b* provide a self-tightening joint between the attachment 20 and the body 210 reduce wobble between the two when joined together. This is particularly useful for embodiments where hair is intended to wrap around the attachment during use as tangential forces can be applied to the joint formed between the attachment 20 and the body 210.

Figure 10:
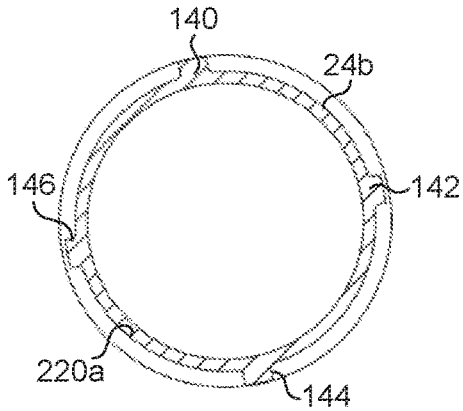
FIG. 10 shows a cross section through another attachment mechanism according to the invention.
Figure 11:
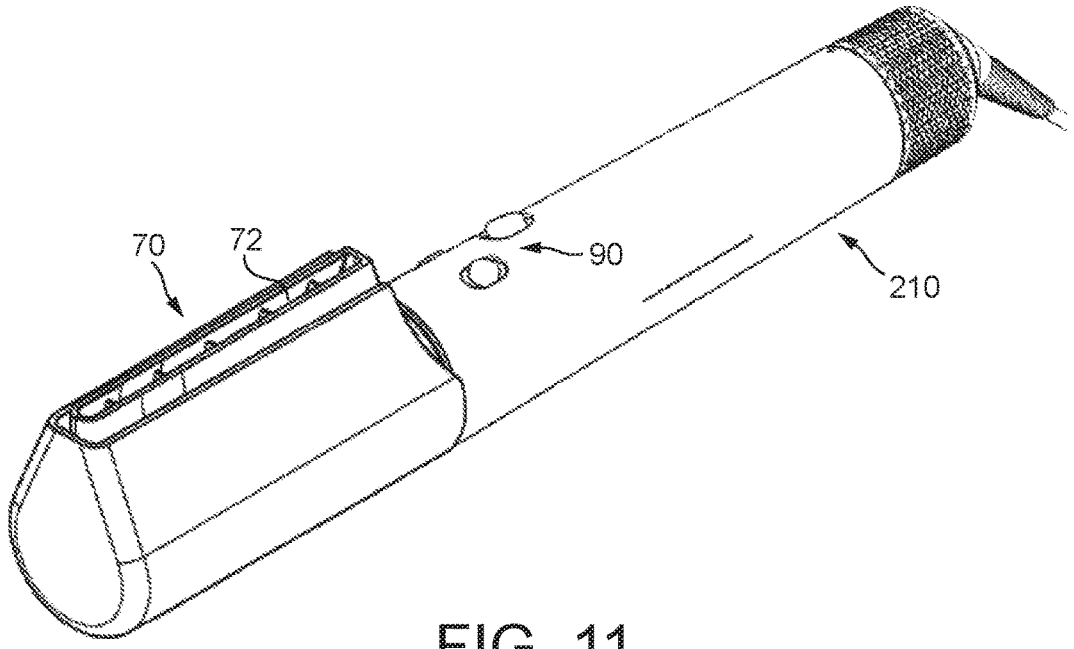
FIG. 11 shows a further appliance which can be used with the attachment mechanism of FIG. 10.

In the embodiment so far described, the attachment 20 can be attached to the body 210 in any orientation. For some embodiments, it may be desirable for the attachment to have fewer orientations. Referring now to FIGS. 10 and 11 the attachment 70 has a directed flow from a single fluid outlet 72. One way to achieve fewer orientations is to provide the protrusions 140, 142 and slots 144, 146 as matched pairs.

Referring now to FIG. 10, a first pair of protrusions 140 extends further from the radially outer surface 24*b* of the collar 22 than a second pair of protrusions 142. Thus, the first pair of protrusions 140 protrudes more than the second pair of protrusions 142. A first pair of slots 144 is formed by a channel which extends further radially into the inner surface 220*a* of the wall 220 than a second pair of slots 146. Thus, the first pair of slots 144 has a greater depth than the second pair of slots 146. Whilst the second pair of protrusions 142 will fit into either of the first and second pairs of slots 144, 146, the first pair of protrusions 140 will only fit into the first pair of slots 144. This thus limits the number of orientations of the attachment 20 with respect to the body 210 to two. Thus, the orientation can be limited to the single fluid outlet 72 being aligned with either button 60 or the user interface 90 providing a user with a comfortable position to hold the appliance whilst being able to access the button 60 and user interface 90 without changing grip.

For the attachment shown in FIGS. 1 to 8, the flange 234 is an external feature that can be seen when the attachment 20 is attached to the body 210. In FIGS. 9 and 11, the flange is an internal feature which has been recessed within the thickness of the outer wall. Both embodiments fall within the scope of the invention.

The invention has been described in detail with respect to a hot styling device however, it is applicable to any appliance that draws in a fluid and directs the outflow of that fluid from the appliance.

The appliance can be used with or without a heater; the action of the outflow of fluid at high velocity has a drying effect.

The fluid that flows through the appliance is generally air, but may be a different combination of gases or gas and can include additives to improve performance of the appliance or the impact the appliance has on an object the output is directed at for example, hair and the styling of that hair.

The invention is not limited to the detailed description given above. Variations will be apparent to the person skilled in the art.

The invention claimed is:

1. A handheld appliance having a body and an attachment, the body comprising an attachment mechanism having a first slot and an actuator, the attachment comprising a first protrusion configured to engage with the first slot, wherein the actuator has a first position and a second position and the actuator is slidably moved from the first position towards the second position in a longitudinal direction of the body as the first protrusion engages with the first slot; wherein the body extends along a longitudinal axis and the first slot extends both radially around and axially along the body.

2. The appliance of claim 1, wherein in the first position, the actuator at least partially obscures the first slot.

3. The appliance of claim 1, wherein the actuator comprises a surface which interacts with the first protrusion when the first protrusion engages with the first slot.

4. The appliance of claim 3, wherein the surface is configured to at least partially define the first slot at or near the second position.

5. The appliance of claim 3, wherein the first protrusion comprises a first face for engagement with the actuator.

6. The appliance of claim 5, wherein the first face engages with the surface of the actuator.

7. The appliance of claim 1, wherein when the first protrusion is at a predetermined position within the first slot, the actuator returns towards the first position.

8. The appliance of claim 7, wherein the actuator retains the attachment on the body.

9. The appliance of claim 1, wherein the actuator is biased into the first position.

10. The appliance of claim 1, wherein the body comprises a wall having an outer surface and an inner surface, and wherein the first slot is a closed channel formed in the inner surface and has a closed end defined by a recess formed at the end of the channel.

11. The appliance of claim 10, wherein the recess is defined by a wall of the first slot.

12. The appliance of claim 11, wherein the first protrusion comprises a second face for engagement with the wall of the first slot.

13. The appliance of claim 12, wherein the second face is curved.

14. The appliance of claim 10, wherein the actuator comprises a second surface which interacts with the first protrusion when the first protrusion engages with the recess.

15. The appliance of claim 1, wherein the body has a first end and a second end and the attachment mechanism is adjacent the second end.

16. The appliance of claim 15, wherein the body comprises a wall having an outer surface and an inner surface and wherein at the second end, the wall comprises a chamfer extending around the inner surface.

17. The appliance of claim 16, wherein the chamfer extends from the inner surface towards the outer surface.

18. The appliance of claim 1, wherein the attachment comprises a collar extending around the attachment and the first protrusion extends from the collar.

19. The appliance of claim 18, wherein the attachment comprises a first end and a second end, the collar is adjacent the first end, and the collar comprises a chamfer.

20. The appliance of claim 19, wherein the chamfer is at the distal end of the collar from the first end of the attachment.

21. The appliance of claim 20, wherein the chamfer extends from the collar radially outwards and towards the second end of the attachment.

22. The appliance of claim 18, wherein the body has a first end and a second end, the attachment mechanism is adjacent the second end, the body comprises a wall having an outer surface and an inner surface, and at the second end, the wall comprises a chamfer extending around the inner surface, and wherein the attachment has a further chamfer that engages the chamfer of the body as the attachment is attached to the body.

23. The appliance of claim 1, comprising a second protrusion and a second slot.

24. The appliance of claim 23, wherein the second protrusion and second slot are radially spaced from the first protrusion and the first slot.

25. The appliance of claim 23, wherein the second protrusion is configured to cooperate with the second slot but not the first slot.

26. The appliance of claim 23 wherein a third protrusion and a fourth protrusion and a third slot and a fourth slot are provided.

27. The appliance of claim 26, wherein the fourth protrusion is adapted to cooperate with the second slot or the fourth slot but not the first slot or the third slot.

28. The appliance of claim 26, wherein each of the first protrusion, the second protrusion, the third protrusion, and the fourth protrusion are radially spaced around the attachment.

29. The appliance of claim 28, wherein each of the first slot, the second slot, the third slot, and the fourth slot are radially spaced around the body.

30. The appliance of claim 1, wherein the appliance is a hair care appliance.

31. The appliance of claim 30, wherein the hair care appliance is a hot styling appliance.

32. The appliance of claim 1, wherein the first slot causes the attachment to pivot relative to the body as the first protrusion engages with the first slot.

33. A handheld appliance having a body and an attachment, the body comprising an attachment mechanism having a first slot and an actuator, the attachment comprising a first protrusion configured to engage with the first slot, wherein the actuator has a first position and a second position and the actuator is slidably moved from the first position towards the second position in a longitudinal direction of the body as the first protrusion engages with the first slot, further comprising a user operated button which engages with the actuator.

34. The appliance of claim 33, wherein actuation of the button moves the actuator from the first position to the second position to facilitate removal of an attachment from the body.

35. A handheld appliance having a body and an attachment, the body comprising an attachment mechanism that comprises a plurality of slots and at least one actuator, the attachment comprising a plurality of protrusions configured to engage with the plurality of slots, wherein the actuator has a first position and a second position and the actuator is moved from the first position towards the second position as a first protrusion of the plurality of protrusions engages with a first slot of the plurality of slots, wherein the body has a first end and a second end and the attachment mechanism is adjacent the second end, wherein the body comprises a wall having an outer surface and an inner surface, wherein at the second end, the wall comprises a chamfer extending around the inner surface, and wherein the attachment comprises a first end, a second end, a collar extending around the attachment adjacent the first end, and the collar comprises a further chamfer.

36. The appliance of claim 35, wherein the chamfer extends from the inner surface towards the outer surface towards the second end of the body.

37. The appliance of claim 35, wherein the further chamfer is at the distal end of the collar from the first end of the attachment.

38. The appliance of claim 35, wherein the further chamfer extends from the collar radially outwards and towards the second end of the attachment.

39. The appliance of claim 35, wherein the chamfer on the body and the further chamfer on the attachment engage each other as the attachment is attached to the body.

* * * * *